US005158141A

United States Patent [19]

Saliger et al.

[11] Patent Number: 5,158,141

[45] Date of Patent: Oct. 27, 1992

[54] COUPLING ARRANGEMENT FOR COMPONENTS IN SUBSEA STRUCTURES AND A REMOTELY OPERATED TOOL UNIT FOR HANDLING SUCH COMPONENTS

[75] Inventors: Kenneth C. Saliger, Desoto, Tex.; Tormod Hals, Vestmarkvegen, Norway

[73] Assignees: Den norske stats oljeselskap a.s, Stavanger, Norway; Mobil Oil Corporation, Fairfax, Va.

[21] Appl. No.: 684,944

[22] PCT Filed: Oct. 9, 1989

[86] PCT No.: PCT/NO89/00104

§ 371 Date: May 13, 1991

§ 102(e) Date: May 13, 1991

[87] PCT Pub. No.: WO90/04083

PCT Pub. Date: Apr. 19, 1990

[30] Foreign Application Priority Data

Oct. 14, 1988 [NO] Norway ..... 884586

[51] Int. Cl.[5] ..... E21B 33/043

[52] U.S. Cl. ..... 166/341; 166/344

[58] Field of Search ..... 166/338, 341, 343, 344, 166/351

[56] References Cited

U.S. PATENT DOCUMENTS

| | | | |
|---|---|---|---|
| 3,096,999 | 7/1963 | Ahlstone et al. | 166/341 X |
| 3,913,669 | 10/1975 | Brun et al. | 166/6 |
| 4,364,433 | 12/1982 | Fisher et al. | 166/344 X |
| 4,387,771 | 6/1983 | Jones | 166/341 |
| 4,411,317 | 10/1983 | Gieswein | 166/347 |
| 4,443,130 | 4/1984 | Hall | 405/190 |
| 4,848,472 | 7/1989 | Hopper | 166/344 |
| 4,856,594 | 8/1989 | Jennings | 166/338 |

FOREIGN PATENT DOCUMENTS

| | | |
|---|---|---|
| 2152556 | 8/1985 | United Kingdom . |
| 2174442 | 11/1986 | United Kingdom . |
| 2201443 | 9/1988 | United Kingdom . |
| WO84/00791 | 3/1984 | World Int. Prop. O. . |

*Primary Examiner*—William P. Neuder
*Attorney, Agent, or Firm*—Foley & Lardner

[57] ABSTRACT

Interface arrangement for components such as valves and control units incorporated in subsea stations particularly for hydrocarbon production, in which the components during operation are mounted in fixed positions on the subsea station and are adapted to be retrieved therefrom by means of a remotely operated tool unit unit (ROT) havign a mating interface arrangement to cooperate with that of the components. The upper part of the component, which is mounted for retrieval in a substantially vertical direction from its fixed position on the subsea station, is provided with central handling means and one or more coupling members. The handling means and the coupling members are adapted to cooperated with respective mating means and members provided on the ROT. Moreover, the handling means is dimensioned for lifting and transporting the component suspended from the ROT. The coupling members are movable up and down in relation to the handling means, when subjected to substantially vertical pull and push forces, respectively, applied from an ROT in an operative position connection to the component through the handling means, so as to effect an operation on the component, for example locking or unlocking thereof with respect tothe subsea station. The top of the handling means is provided with ports and/or connectors for hydraulic, pneumatic, optical or electric interconnection between the component and an ROT.

19 Claims, 6 Drawing Sheets

COUPLING ARRANGEMENT FOR COMPONENTS IN SUBSEA STRUCTURES AND A REMOTELY OPERATED TOOL UNIT FOR HANDLING SUCH COMPONENTS

BACKGROUND OF THE INVENTION

This invention in general relates to an arrangement for interfacing retrievable subsea components particularly for hydrocarbon production, and a remotely operated tool unit (ROT) intended to cooperate with such components for performing operations thereon, for example locking or unlocking to/from the subsea structure and carrying a component between the surface and its subsea location.

The components of interest in this regard may be of various types, such as valves, control units or other types of separate retrievable units. During operations these components are mounted in fixed positions and in such a manner that they may be retrieved by means of a remotely operated tool unit (ROT).

OBJECTS AND SUMMARY OF THE INVENTION

An important aspect of this invention is a common interface to several or all components concerned. The common interface has been devised in order to limit the number of different installation tools for the various components.

The invention also comprises features related to the ROT as such, as well as mechanisms belonging to some types of components, since the interface arrangement to some extent will influence the structure and functions incorporated in both the ROT and the components concerned Essentially this invention is directed to the task of making it possible for an ROT to access and interface a subsea structure with equipment modules installed therein, comprising retrievable components or units as mentioned above. A particularly important aspect in this regard is the ability of an ROT to provide locking and unlocking forces to mechanical connectors fixing the retrievable components or units to mating connector means on the subsea structure. However, also other operations on subsea installed components may be contemplated here.

A basic principle behind the solutions to be presented in the following description, and in particular in the claims, may be seen in the generally vertical application of forces or vertical movements involved, this being related to the orientation of the components or units concerned, these being mounted for retrieval in a substantially vertical direction from a fixed position on the subsea structure.

BRIEF DESCRIPTION OF THE DRAWINGS

Reference is now made to the drawings, in which.

DETAILED DESCRIPTION OF THE PREFERRED EMBODIMENTS

Figure 1:
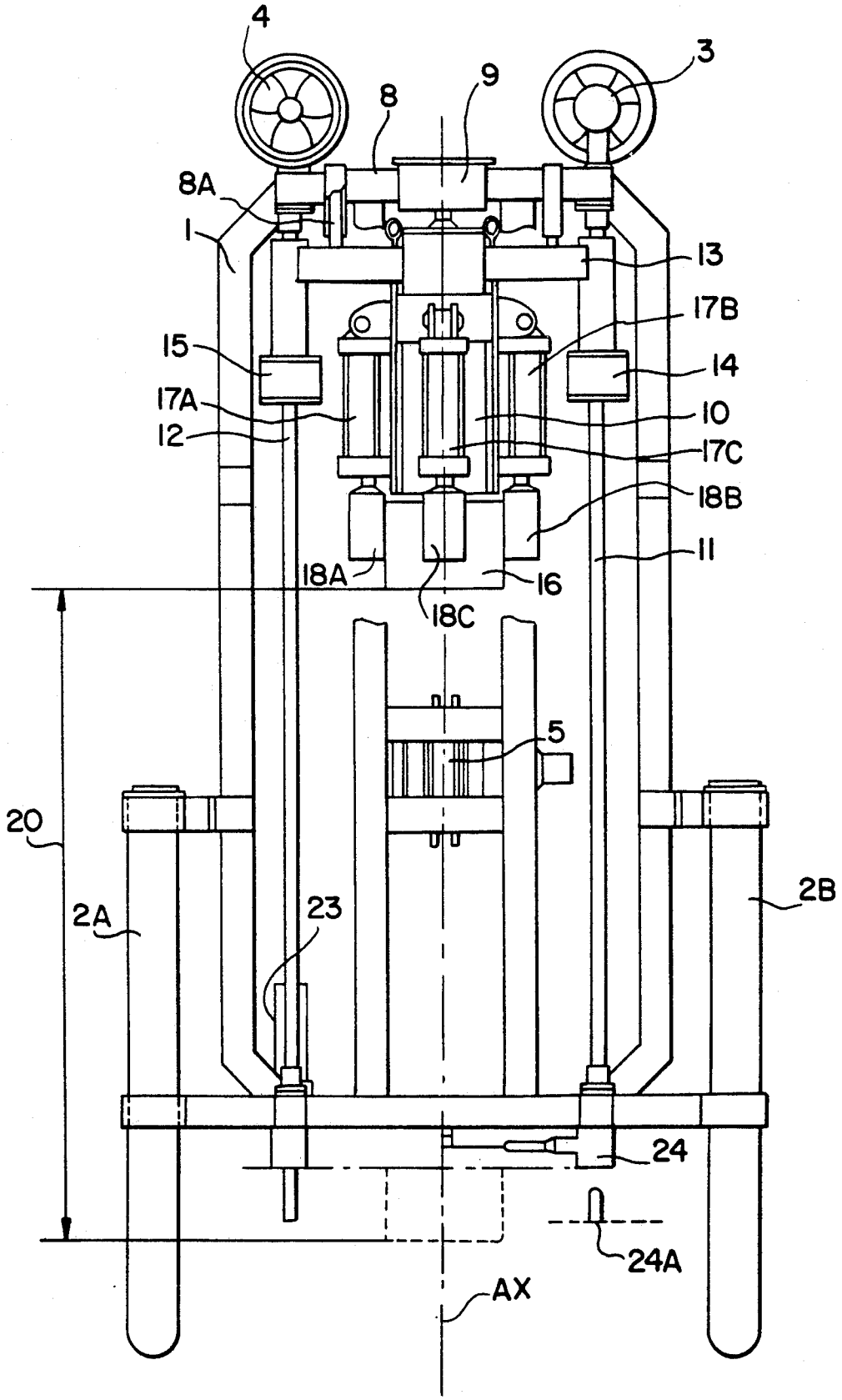
FIG. 1 somewhat simplified and in elevation shows a remotely operated tool unit (ROT) embodying aspects of this invention

The subsea ROT illustrated in the drawings, is a self-contained unit serving primarily as a manipulating and transport tool for the installation and recovery of subsea components. The ROT is usually deployed on a lift wire, or a drill pipe from a surface vessel, and is built up within a support and protection frame more or less shaped as a cage. Guidance and landing of such an ROT on a subsea structure will generally be by the conventional haul-down method, but a guideline system or full thruster positioning may be used during deployment from a surface vessel.

Figure 2:
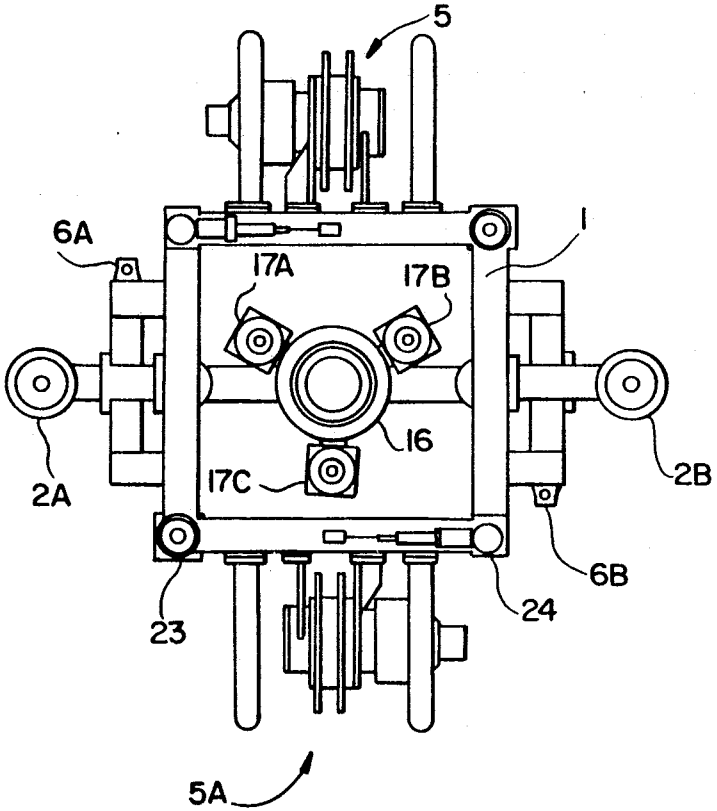
FIG. 2 shows the ROT of FIG. 1 from below.

As seen particularly in FIGS. 1 and 2, the illustrated embodiment of the ROT has a cage-like support and protection frame 1 within which a manipulating tool comprising an interface arrangement is mounted. FIG. 2 specifically shows haul-down winches 5 and 5A to assist in location and landing of the ROT on a subsea structure or a part thereof. The haul-down winches cooperate with a heave compensator on the surface vessel to eliminate the ROT heave motions. The ROT is also provided with a hydraulic power unit (not shown) for necessary hydraulic functions. As will be understood the ROT should further incorporate control and monitoring equipment connected to an installation or vessel at the surface by an electrical umbilical cable which includes a power supply for the hydraulic power units just mentioned, and including signal cables.

At the base of the supporting, structural frame or cage 1 there are integrated two soft landing shock absorbers 23 and two hydraulically operated lockdown mechanisms 24 for securing the ROT to a landing platform or the like on the subsea structure. Externally on the frame 1 there are provided two guide posts or guide funnels 2A and 2B which may be retractable for handling purposes. At the top of the ROT there are mounted one or more hydraulically or electrically powered thrusters 3, 4 for guidance of the ROT. For the possible use of guideline based installation procedures, there are included two wire guides 6A, 6B (FIG. 2).

Figure 3:
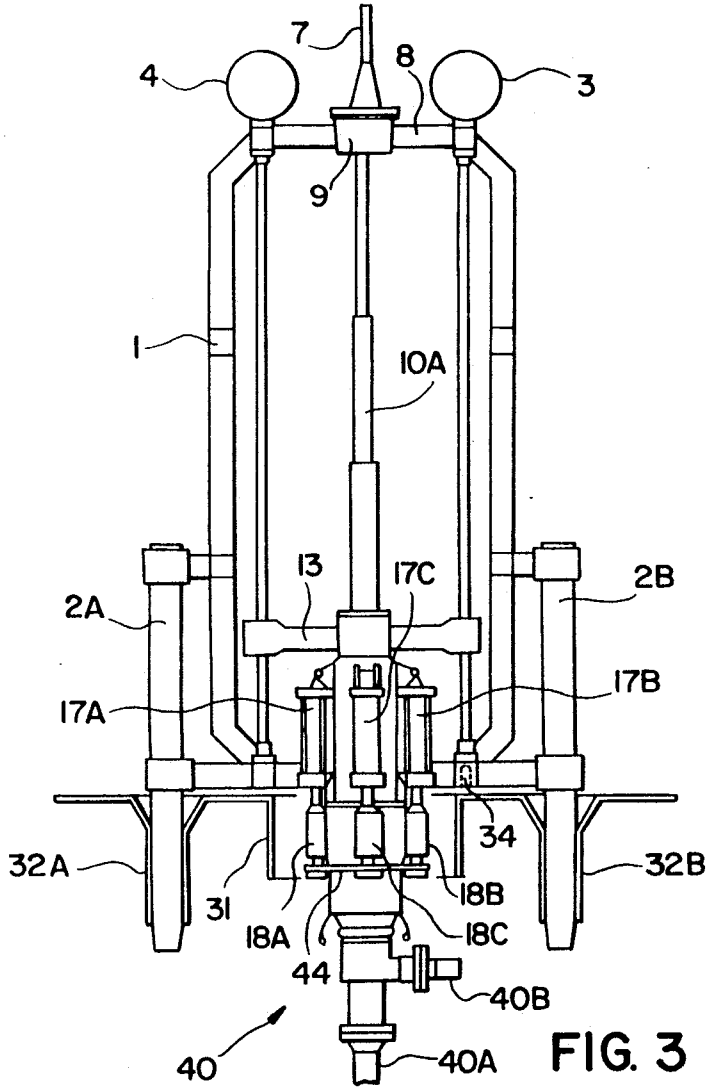
FIG. 3 shows details on the same ROT as in FIGS. 1 and 2, landed on a subsea structure and interfaced with a subsea structure component for effecting an operation on or with that component.

On top of the cage 1 there is a transverse frame member 8 with a central anchoring member or joint 9 from which there is suspended an elevator assembly arranged to be moved in a longitudinal or height direction within the frame 1 guided by guide rods 11 and 12 along which can slide wing bearings 14 and 15 respectively, incorporated in the supporting or main structure constituting the elevator. This structure also comprises a transverse member 13. A hydraulic cylinder unit, shown at 10A in FIG. 3, is connected to transverse frame member 8 and to the elevator transverse member 13 for moving the elevator within frame 1. In FIG. 1 the elevator or hydraulic cylinder is generally indicated at 10. A locking device 8A with cooperating parts on the respective transverse members 8 and 13, is provided for securing the elevator in its upper position when carrying a component and also to restrict movement of bearings or the like during transportation.

An essential feature of the interface arrangement incorporated in the tool carried by the elevator is a handling connector 16 aligned with the vertical or central axis AX of the ROT and elevator, and dimensioned for lifting and transporting any one of the components concerned, in particular for retrieving such a component from the subsea structure to the surface. For such operations the handling connector 16 is connected to mating handling means in the form of a handling hub on the top of the component.

The interface arrangement also comprises one or more coupling members or smaller connectors 18A, 18B and 18C with associated hydraulic cylinders 17A, 17B and 17C respectively, for moving connectors 18A–C up or down with the central handling connector 16 remaining stationary. The smaller coupling connectors 18A–C with their respective hydraulic cylinders are used to connect to and operate mating coupling members in a complementary interface arrangement on each of the components to be interfaced with the ROT.

FIG. 3 illustrates a situation in which the central handling connector 16 and the coupling connector members 18A, 18B and 18C have been connected to mating means and members at the top of a component generally indicated at 40. This component is for example a choke valve the stationary valve body of which is incorporated in a piping system of the subsea system concerned, through connecting conduits shown at 40A and 40B with flange connections to the valve 40. At 44 there is generally indicated a level or plane at which the completed interface arrangement between the ROT and the component may be considered to be located. It should be noted however, that this interface will not generally comprise means or members all lying in the same plane. In fact, the interface arrangement comprises members being adapted to move in a direction normal to the interface "plane", i.e. vertically in FIGS. 1 and 3. Further details of the interface arrangement will appear from the description of FIG. 4.

FIG. 3 also illustrates how the ROT is landed on a sort of platform 30 having guide funnels 32A and 32B for the guide posts 2A and 2B respectively, on the ROT. When referring to the landing area, the miniposts to which the ROT is secured and locked are not described nor shown on the figure, The locking arrangement is shown on FIG. 1,24. Moreover there is an elevator access area defined by a wall 31 underneath the platform 30, the top portion of valve component 40 being accessible through this area. Possibly the landing platform 30 with necessary associated structure may be arranged on a fixed or removable roof element for a subsea structure as described in the applicant's simultaneous, U.S. patent application Ser. No. 07/684,942. Also as an alternative, the landing platform 30 could normally be covered by a small removable roof element as described in the application just mentioned, preferably with a roof element of such design that it can be removed by means of the ROT itself.

Guide funnels 32A,B and posts 2A,B provide for a first step of coarse guidance for landing the ROT. A second and more exact guide function is obtained by means of two small posts projecting from platform 30 to cooperate with funnels associated with lockdown mechanisms 24 shown schematically in FIG. 1. One small post 24A is depicted below mechanism 24 in FIG. 1. At 34 in FIG. 3 there is shown a post 34 entered into a funnel or mechanism corresponding to mechanisms 24 in FIG. 1. A locking pin is hydraulically operated to enter a transverse hole in the small post, thereby locking and securing the ROT to the platform 30.

Obviously, the arrangement of guide funnels and posts can be inverted from what is just described. Thus, for example guide funnels 32A,B could belong to the ROT, with posts 2A,B projecting from platform 30, the former arrangement, however, being preferred.

In spite of the two guidance steps explained, there may still be a need for further accuracy when installing a component on a subsea structure with an ROT. Therefore, as will appear in particular from FIGS. 4 and 6, the component is also provided with guide means, such as guide pins for a third and final alignment step with respect to the housing or socket in which the component shall be mounted. In order to make this final alignment possible, taking into account unavoidable tolerances in landing and component arrangements as well in the ROT structure itself, the ROT elevator 10 with interface connectors 16 and 18A–C is suspended with some degree of play or float laterally. This is provided for (see FIG. 1) by bearings 14, 15 sliding on rods 11, 12, and supporting members 9,13.

At the top of the ROT in FIG. 3 there is shown a wire or cable 7 extended to the surface, for hoisting the ROT and possibly for electrical connections therewith. The dry weight of the complete ROT will for example be approximately 4 tons with a height of perhaps 4 meters, whereas the width may be from 1,5 to 2,0 meters. These dimensions of course depend on the size and weight of the components to be handled and retrieved.

Figure 4:
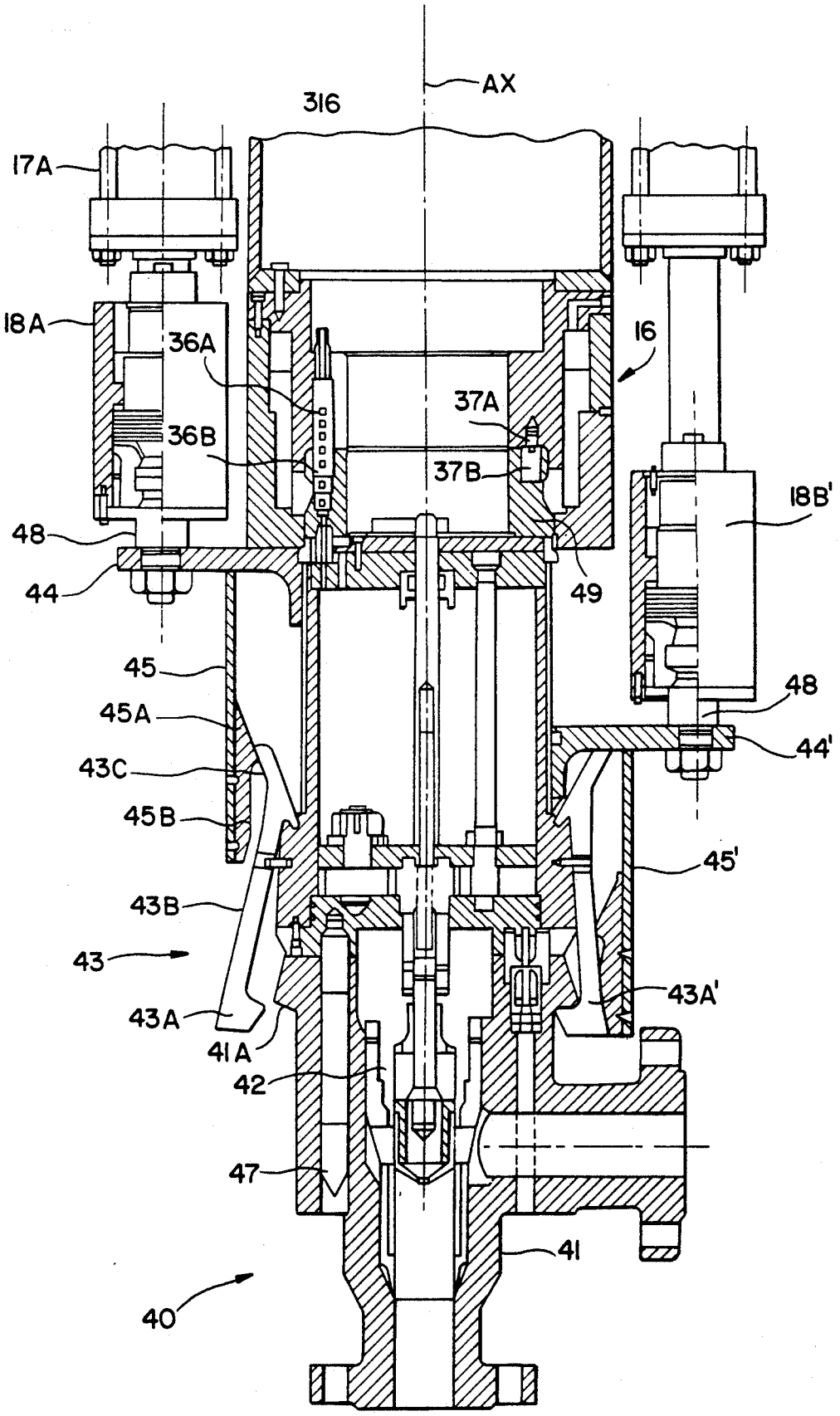
FIG. 4 is a vertical section showing the interface arrangement between the ROT and the component in FIG. 3

Turning now to FIG. 4 the valve 40 is seen to comprise a valve body or housing 41 into which a retrievable valve insert assembly generally indicated at 42, can be mounted. This can for example be a choke valve, the critical parts of which from time to time must be retrieved to the surface for maintenance and the like. Thus, strictly speaking, the "component" referred to above (FIG. 3), in this example is represented by the retrievable insert assembly 42, substantial parts of which are located outside the valve cavity within body housing 41, i.e. above this housing.

At the top of this component there is provided a handling hub 49 having a shape and dimensions adapted to be engaged by the handling connector 16 of the ROT. In addition to handling hub 49 the interface arrangement of the component comprises three coupling members or mandrels 48, of which one is shown in engagement with a respective coupling connector member 18A in FIG. 4. The connections 16,49 and 18A,48 may be of more or less conventional designs, which makes possible the transfer of both push- and pull forces thereby. What is of particular interest in the present context is the essentially axial or vertical movements and force directions involved, which is of significance in view of the retrieval of the components in a substantially vertical direction from a fixed position on the subsea structure, as mentioned above.

Before studying further details of the interface arrangements illustrated in FIG. 4, it should be noted that the left-hand part of the drawing illustrates the mechanism in a position in which the valve insert or component is unlocked from the valve housing 41, whereas in the right hand part of the drawing there is established a lock between the valve insert 42 and the housing 41. This locking is provided for by a connector assembly 43 comprising movable locking pieces 43A designed for cooperation with corresponding locking abutments 41A at the upper part of housing 41. Locking is obtained by pushing down a sleeve 45 which by means of inclined internal camming surfaces 45B therein engaging surfaces 43B on the locking pieces 43A, move these into the position illustrated at 43A as shown in the right-hand part of FIG. 4.

The necessary push-down force for moving the sleeve 45 from the upper (or left-hand) position in FIG. 4 to the lower (or right-hand) position is exerted by the hydraulic cylinders 17A–C through the coupling connector members 18A–C. The mandrels 48 are mounted on a common yoke or annular plate 44 at the underside cf which the above sleeve 45 is mounted. The yoke or plate 44 is referred to above in connection with FIG. 3, as the level or "plane" of the interface arrangement.

For releasing locking pieces 43A when the sleeve 45 has been retracted upwards as shown in the left-hand part of FIG. 4, unlocking is provided for by cooperating inclined surfaces 45A and 43C bringing about a rocking motion of locking piece 43A, thereby displacing the lower end thereof to be disengaged from abutment 41A.

On the top surface of handling hub 49 there are shown ports or connectors 36B and 37B forming a significant part of the interface arrangement belonging to the removable or retrievable component 42 including the connector mechanism 43. For cooperation with ports or connectors 36B, 37B, the handling connector 16 of the ROT on mating surface is provided with corresponding ports or connectors 36A and 37A, for example in the form of stabs adapted to enter into respective ports in the handling hub 49. Whereas such handling hubs may have a different number and arrangement of such ports or connectors, depending on the requirements of the component concerned, the handling connector 16 must have a complete or full number and arrangement of such ports and connectors to enable it to interface the various components which it may be of interest to handle.

Figure 5:
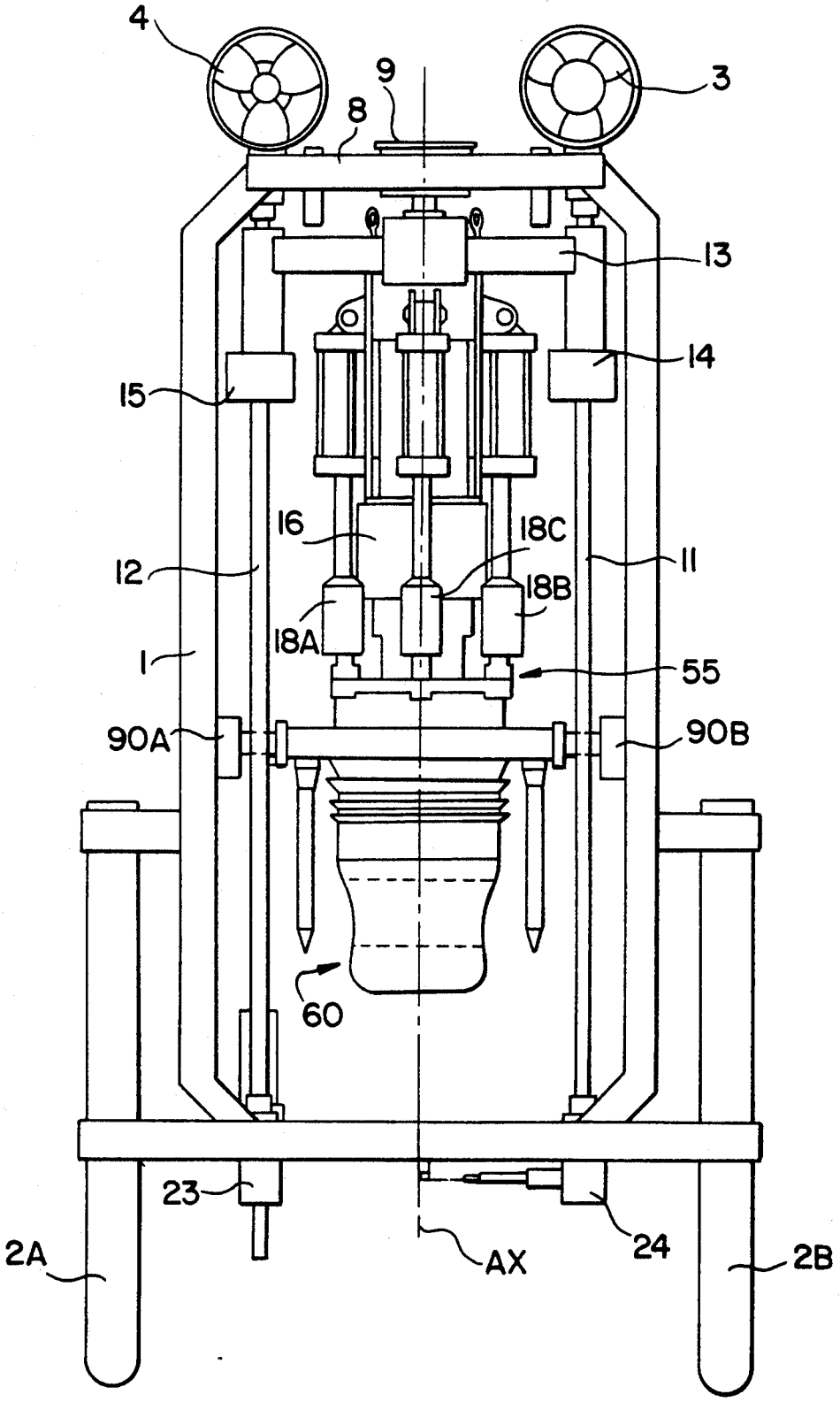
FIG. 5 shows the ROT on FIGS. 1 and 2 handling another type of component.

FIG. 5 shows the ROT as described above with respect to FIGS. 1, 2 and 3, having retracted component 60 by means of the elevator, completely within the supporting frame 1, for example in order to retrieve the component to the surface from a subsea station. Component 60 may be a retrievable valve insert as described in simultaneous U.S. patent application Ser. No. 07/684,941. The mating or common interface arrangements, as generally indicated at 55 in FIG. 5, in this case also comprises the central ROT handling connector 16 engaging a handling hub at the top of component 60, and coupling connector members 18A-C engaging coupling members or mandrels projecting upwards from an annular yoke similar to the one shown at 44 on FIG. 4. Further details with respect to component 60 in FIG. 5, will be described below with reference to FIG. 6.

Figure 8:
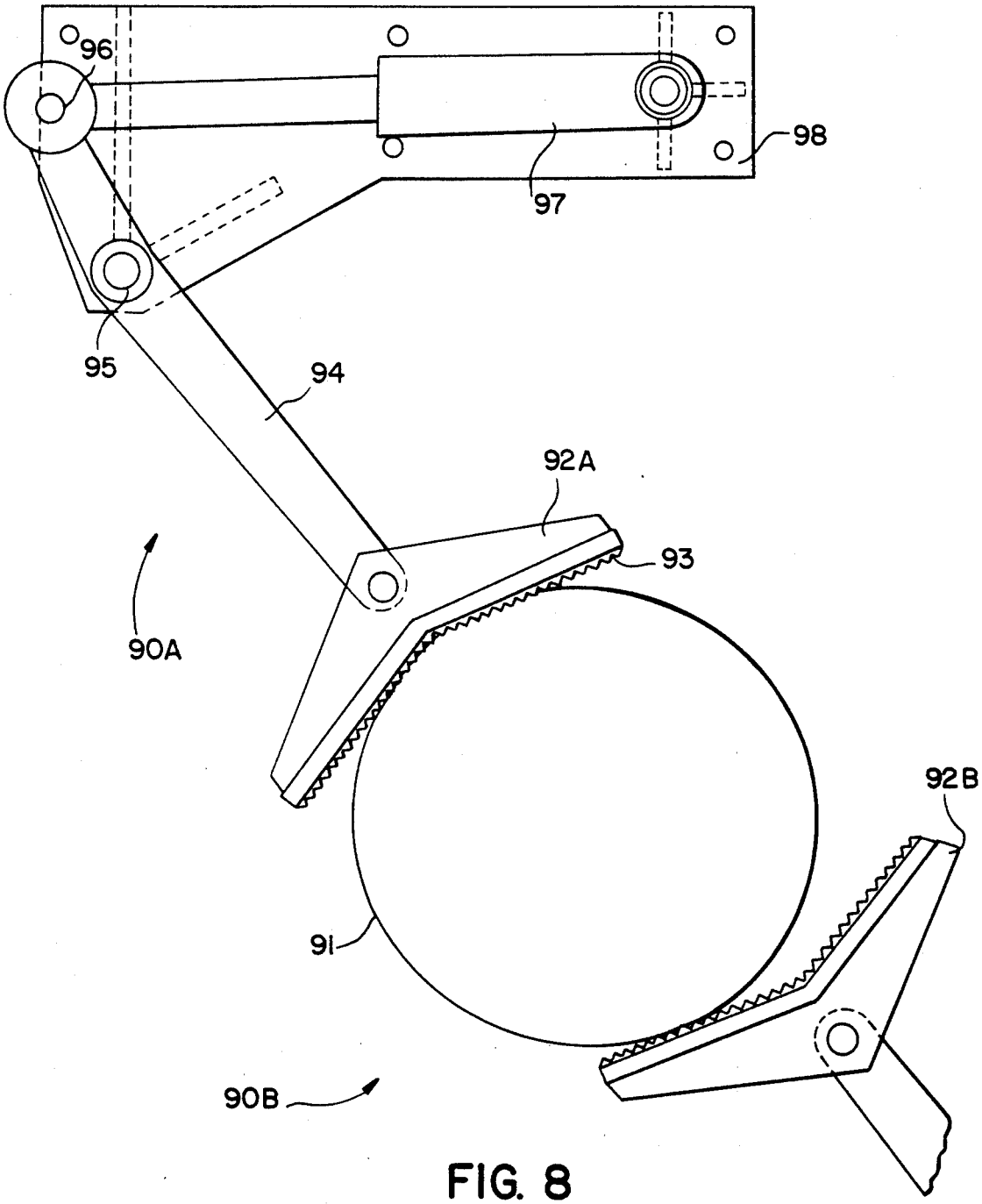

For securing ccmponent 60 during transportation and retrieval to the surface by means of the ROT, there are provided supporting or clamping devices 90A and 90B mounted on the frame 1 and adapted to laterally engage and secure component 60 when suspended from the elevator. FIG. 8 shows more in detail an embodiment of such devices. Thus, in FIG. 8 one device 90A is shown as a whole, whereas device 90B is only partly includes in the drawing. The plan view of FIG. 8 schematically shows ccmponent 91 which is engaged by two clamping shoes 92A and 92B, preferably engaging component 91 from opposite sides. As indicated at 93 these shoes may have a resilient padding or cushion so as to avoid damage to component 91. Clamping shoe 92A is pivotably attached to a lever arm 94 being journalled at 95 and having an opposite end 96 connected to the piston rod of an actuator cylinder 97, thus providing for the necessary clamping movement cf shoe 92A against component 91. A supporting plate or frame 98 may be adjustably mounted within the ROT frame 1 to adapt the device to different component diameters.

Figure 6:
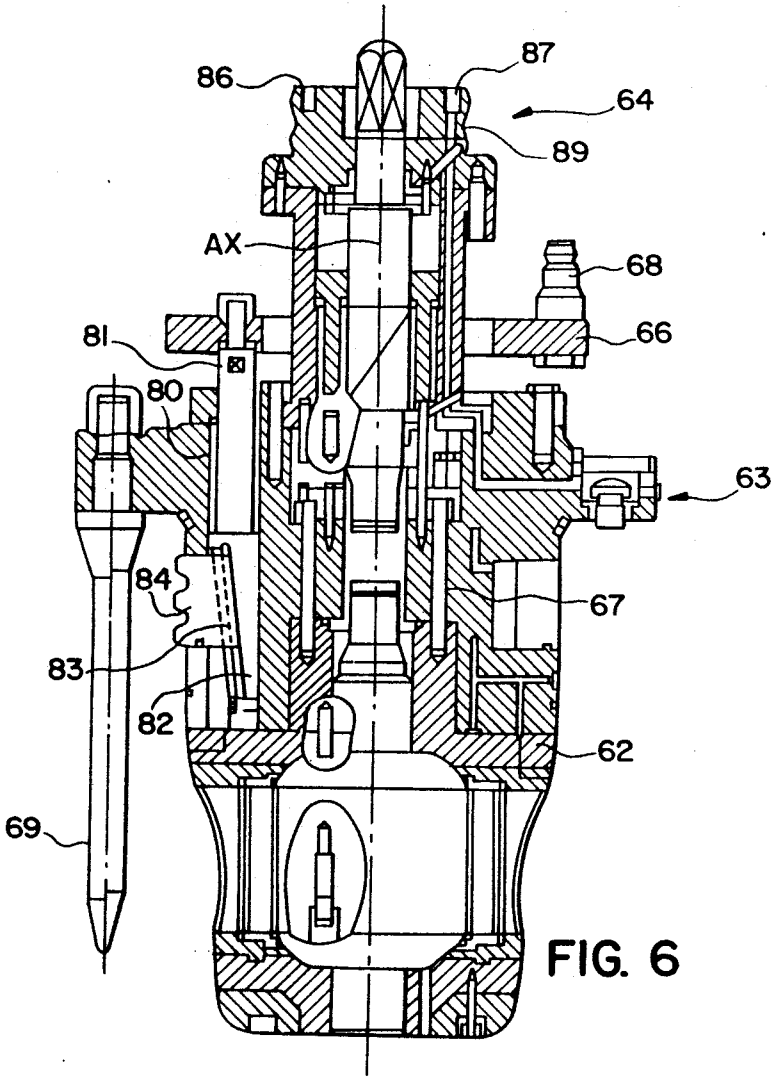
FIG 6 is a vertical section through the interface arrangement between the ROT and the component shown in FIG. 5, FIG. 7 in elevation and partial section shows another example of component having an interface arrangement according to an embodiment of this invention, and FIG. 8 in plan view shows a device for securing a component in an ROT during transportation or retrieval.

Component 60 (FIG. 5) shall now be described somewhat more in detail referring to FIG. 6. Main parts of this component are valve insert 62 for a ball valve, connector means 63 for locking to a valve housing, and a valve actuator 64. The same main parts are illustrated and further described in the above simultaneous patent application.

Connector 63 is joined to valve insert 62 by bolts 67. A guide pin 69 is adapted to cooperate with a corresponding guide hole in the valve housing. The interface arrangement here is composed of handling hub 89 and three mandrels 68 spaced 120° around the periphery of an annular yoke 66, which is in turn being movable in a vertical direction in FIG. 6, in relation to handling hub 89.

A number of push-pull rods 81 have their upper ends connected to yoke 66 and are slidable in bores 80 to bring about lateral movement of locking pieces 84 having teeth or grooves in the external surface intended for engagement with correspondingly shaped locking means inside the valve housing into which the component or valve insert is to be mounted. In the position illustrated in FIG. 6, yoke 66 and therefore rod 81 has been pushed down and accordingly locking piece 84 assumes its locking position. This transformation of the axial or vertical movement of rod 81 to the lateral movement of locking piece 84 is brought about by interengaging inclined surfaces as indicated at 83 at the lower end portion 82 of rod 81 and at the inner side of locking piece 84 respectively. These inclined surfaces 83 may be in the form of a grooved profile enabling positive outward as well as inward displacement of locking piece 84. Thus, a pulling force applied to mandrels 68 from an ROT interface, moving push-pull rod 81 upwards, results in inward movement of locking piece 84 so that unlocking cf the component is obtained.

The connector means briefly described above is more fully covered by the simultaneous U.S. patent application Ser. No. 07/684,943.

At the top surface of handling hub 89 there are indicated ports or connectors 86, 87 which interface with mating ports or connectors arranged in a bottom surface of the ROT handling connector.

Figure 7:
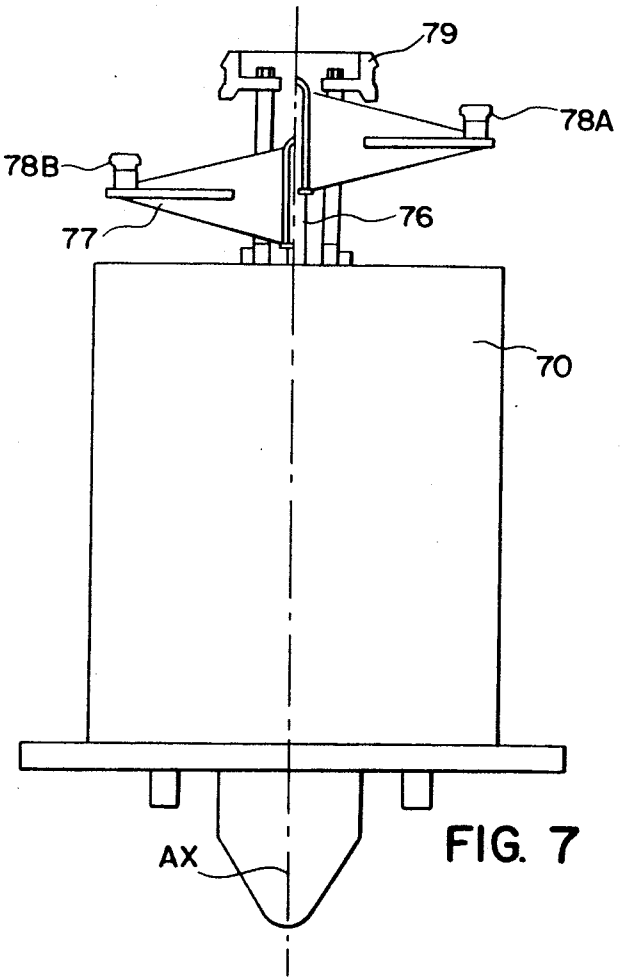

Turning now to FIG. 7, a further type of component 70 is schematically shown. This may be a control unit or control pod containing necessary parts and equipment for various control functions pertaining to a subsea station or subsea station module. This component, like the above described components, is provided with a handling hub 79 the axis of which is also a central axis of the complete component 70. To the left of axis AX there is shown a yoke member 77 with a connector mandrel 78B in a lower position, whereas at the right-hand side of axis there is shown a mandrel 78A in an upper position. It will be realized that mandrels 78A and 78B, as well as one or more additional mandrels in this interface arrangement, may all be constrained to move in unison by being mounted on the common yoke 77. Push-pull rod 76 is provided for transferring push-pull movements or forces into component 70, possibly for performing locking or unlocking thereof with respect to the subsea station.

We claim:

1. An interface arrangement, provided on a retrievable component incorporated in a subsea structure, for coupling said component to a mating interface arrangement of a remotely operated tool unit (ROT) which retrieves said component from a fixed position on said subsea structure, said mating interface arrangement of said ROT including a plurality of coupling devices, said interface arrangement comprising:

(A) a central handling means, provided on an upper portion of said component, for lifting and transporting said component, said handling means being provided with at least one of ports and connectors, said at least one of ports and connectors providing at least one of hydraulic, pneumatic, optical, and electrical interconnections between said ROT and said component;

(B) a plurality of coupling members which are laterally and symmetrically offset from an axis of said central handling means and which selectively cooperate with said plurality of coupling devices so as to allow said ROT to manipulate said component; and (C) a yoke member which interconnects said plurality of coupling members so as to allow said plurality of coupling members to be moveable in unison up and down in relation to said handling means when subjected to substantially vertical push and pull forces from said ROT.

2. The arrangement as claimed in claim 1, wherein said plurality of coupling members comprises three coupling members spaced 120° apart about said axis of said handling means.

3. The arrangement as claimed in claim 1, wherein said interface arrangement cooperates with said subsea structure such that said push force causes one of locking said component to said subsea structure and unlocking said component from said subsea structure, and said pull force causes the other of locking said component to said subsea structure and unlocking said component from said subsea structure.

4. The interface arrangement according to claim 1, further comprising connector means for locking and unlocking said component to and from said subsea structure, and a push-pull element which is connected to at least one of said coupling members and which actuates said connector means, said connector means comprising a locking piece which moves laterally when actuated by said push-pull element and which is engaged with and disengaged from a mating locking device on said subsea structure.

5. The interface arrangement according to claim 4, further comprising an inclined cam surface which is provided on one of said push-pull element and said locking piece and which transforms axial movement of said push-pull element into lateral movement of said locking piece.

6. The interface arrangement according to claim 5, wherein said cam surface is provided at such an angle in relation to said axis that said locking piece will remain locked in a position in which it is engaged with said locking device unless it is subjected to said pull force.

7. The interface arrangement according to claim 1, further comprising connector means for locking and unlocking said component to and from said subsea structure, and a plurality of push-pull rods which are larger than said coupling members, which are connected to said coupling members, and which actuate said connector means, said connector means comprising a plurality of locking pieces which move laterally when actuated by a corresponding one of said push-pull rods and which are selectively engaged with and disengaged from mating locking devices on said subsea structure, each of said push-pull rods having a first end which is connected to said yoke member and a second end which actuates the respective one of said locking pieces.

8. A system comprising:

(A) a retrievable component which is incorporated in a subsea structure and which has a first interface arrangement provided thereon; and (B) a remotely operated tool unit (ROT) which retrieves said component from a fixed position on said subsea structure, said ROT having a second interface arrangement for coupling said ROT to said first interface arrangement and for manipulating said component, said second interface arrangement including (i) a central handling connector means for lifting and transporting said component, said central handling connector means having a lower part which is provided with at least one of ports and connectors, said at least one of said ports and said connectors providing at least one of hydraulic, pneumatic, optical, and electrical interconnections between said ROT and said component, (ii) a plurality of coupling connector members which are laterally and symmetrically offset from an axis of said central handling connector means and which selectively cooperate with said first interface arrangement so as to allow said ROT to manipulate said component, and (iii) activation means for moving said coupling connector members up and down such that said coupling connector members apply substantially vertical pull and push forces on said component when said ROT is connected to said component through said handling connector means.

9. The system as claimed in claim 8, wherein said plurality of coupling connector members comprises three coupling members spaced 120° apart about said axis of said handling connector means.

10. The system as claimed in claim 8, wherein said activation means comprises a plurality of hydraulic cylinders, each of which is connected to one of said coupling connector members.

11. The system as claimed in claim 8, wherein said ROT comprises a supporting frame, guide posts, mounted on said supporting frame, for landing said ROT on said subsea structure;

means for controlling and guiding said supporting frame from the surface; and an elevator which is mounted for vertical movement within said supporting frame and which carries said handling connector means and said coupling connector members.

12. The system according to claim 11, wherein said elevator is capable of travelling to an upper vertical position for retracting said component completely within said supporting frame.

13. The system according to claim 12, further comprising means for securing said elevator in said upper vertical position within said supporting frame so that said component is secured within said supporting frame for transporting.

14. The system according to claim 11, further comprising means for laterally engaging and securing said component to said elevator such that said component is suspended from said elevator and is secured within said supporting frame so that said component can be transported in a secure and protected manner.

15. The system according to claim 11, wherein said elevator is moveable laterally with respect to said axis of said handling connector means when said elevator moves vertically within said frame so as to allow corresponding lateral movement of said component, and further comprising guide means for laterally moving said component with respect to said supporting frame to align said component for mounting on said subsea structure.

16. The system according to claim 11, wherein said guide posts provide a first step of coarse guidance of said component, and further comprising guides which are smaller than said guide posts and which provide a second step of more precise guidance of said component onto a landing area of said subsea structure and which lock said component to said subsea structure.

17. An interface arrangement, provided on a remotely operated tool unit (ROT) which retrieves a component from a fixed position on s subsea structure, for coupling said ROT to a mating interface arrangement on said component and for manipulating said component, said interface arrangement comprising:

(A) a central handling connector means for lifting and transporting said component, said central handling connector means having a lower part which is provided with at least one of ports and connectors, said at least one of said ports and said connectors providing at least one of hydraulic, pneumatic, optical, and electrical interconnections between said ROT and said component, and (B) a plurality of coupling connector members which are laterally and symmetrically offset from an axis of said central handling connector means and which selectively cooperate with said mating interface arrangement of said component so as to allow said ROT to manipulate said component; and (C) activation means for moving said coupling connector members up and down such that said coupling connector members apply substantially vertical pull and push forces on said component when said ROT is connected to said component through said handling connector means.

18. The interface arrangement as claimed in claim 17, wherein said plurality of coupling connector members comprises three coupling members spaced 120° apart about said axis of said handling connector means.

19. The interface arrangement as claimed in claim 17, wherein said activation means comprises a plurality of hydraulic cylinders, each of which is connected to one of said coupling connector members.

* * * * *